United States Patent [19]

Kadija et al.

[11] 4,140,615

[45] Feb. 20, 1979

[54] CELL AND PROCESS FOR ELECTROLYZING AQUEOUS SOLUTIONS USING A POROUS ANODE SEPARATOR

[75] Inventors: Igor V. Kadija; Byung K. Ahn, both of Cleveland, Tenn.

[73] Assignee: Olin Corporation, New Haven, Conn.

[21] Appl. No.: 782,117

[22] Filed: Mar. 28, 1977

[51] Int. Cl.[2] ..... C25B 9/00

[52] U.S. Cl. ..... 204/266; 204/283; 204/284; 204/290 F; 204/98

[58] Field of Search ..... 204/266, 283, 284, 290 F, 204/296, 98

[56] References Cited

U.S. PATENT DOCUMENTS

| | | | |
|---|---|---|---|
| 3,959,095 | 5/1976 | Marks et al. | 204/98 |
| 4,032,427 | 6/1977 | Kadija | 204/283 |
| 4,035,255 | 7/1977 | Gritzner | 204/98 |

*Primary Examiner*—Charles F. Lefevour

*Attorney, Agent, or Firm*—James B. Haglind; Donald F. Clements

[57] ABSTRACT

Electrolysis of alkali metal chloride solutions to produce chlorine and alkali metal hydroxides is accomplished in a cell comprising an anode compartment, a cathode compartment, a cation permeable divider separating the anode compartment from the cathode compartment, where the anode compartment contains an anode separator. The anode separator is comprised of a porous plate of a valve metal having an electrochemically active coating on the face, and an electrochemically non-active barrier layer on the back and a portion of the interior. The anode separator is positioned in the anode compartment so that the back of the anode separator is spaced apart from the cation permeable divider. An alkaline brine zone is formed between the anode separator and the cation permeable divider which increases the service life of the cation permeable divider. In addition, the anode separator provides improved chlorine gas separation properties, increased service life for the electroconductive coating on the face, and enables the cell to operate with a reduced cell voltage.

17 Claims, 4 Drawing Figures

CELL AND PROCESS FOR ELECTROLYZING AQUEOUS SOLUTIONS USING A POROUS ANODE SEPARATOR

This invention relates to electrodes for use in electrolytic cells. More particularly, this invention relates to a cell and a process for electrolyzing aqueous solutions to produce gaseous products employing porous metal anodes.

It is known to employ porous metal diaphragms in electrolytic cells. U.S. Pat. No. 3,222,265, issued to H. B. Beer describes a porous metal diaphragm consisting of a porous plate of titanium having a thin layer of a noble metal on one side and a barrier layer of titanium dioxide on the other side. The pores in the diaphragm were substantially perpendicular to the faces of the plate. The diaphragm had a thickness of a fraction of a millimeter and could be used as an anode by applying current along the side of the plate coated with the noble metal.

The diaphragm of U.S. Pat. No. 3,222,265 having rectilinear pores was produced, for example, by etching the titanium plate or mechanically perforating the plate. The resulting diaphragm is a fragile structure having limited gas separation properties. In addition, there is little control over the amount of penetration of the noble metal coating into the porous plate. The short rectilinear pores have no means for preventing gas flow back through the porous structure.

In the method of U.S. Pat. No. 3,222,265, the porous metal diaphragm is placed in the electrolyte so that it separates the anolyte from the catholyte.

Therefore, there is a need for a cell and a process employing a porous anode which provides improved gas separation. In addition, there is need for a cell and process employing a porous anode which will prevent gas flow in an undesired direction and which results in reduced energy costs.

It is an object of the present invention to provide a cell and process for electrolyzing alkali metal chloride solutions having improved gas separation properties.

Another object of the present invention is a cell and process for electrolyzing alkali metal chloride solutions which provides increased service life for the cation permeable divider employed.

An additional object of the present invention is a cell and process for the electrolysis of alkali metal chloride solutions which produces purer chlorine and reduces the formation of alkali metal chlorates and alkali metal hypochlorites in the anolyte.

A further object of the present invention is a cell and process for electrolyzing alkali metal chloride solutions having reduced cell voltage.

A still further object of the present invention is a cell and process for electrolyzing alkali metal chloride solutions providing increased service life for the electroconductive coating on the anode.

These and other objects of the present invention are accomplished in a novel cell for electrolyzing alkali metal chloride solutions comprised of an anode compartment, a cathode compartment, a cation permeable divider separating the anode compartment from the cathode compartment, the anode compartment containing an anode separator.

The novel cell of the present invention is illustrated in FIGS. 1-4. Corresponding parts have the same numbers in all FIGURES.

Figure 1:
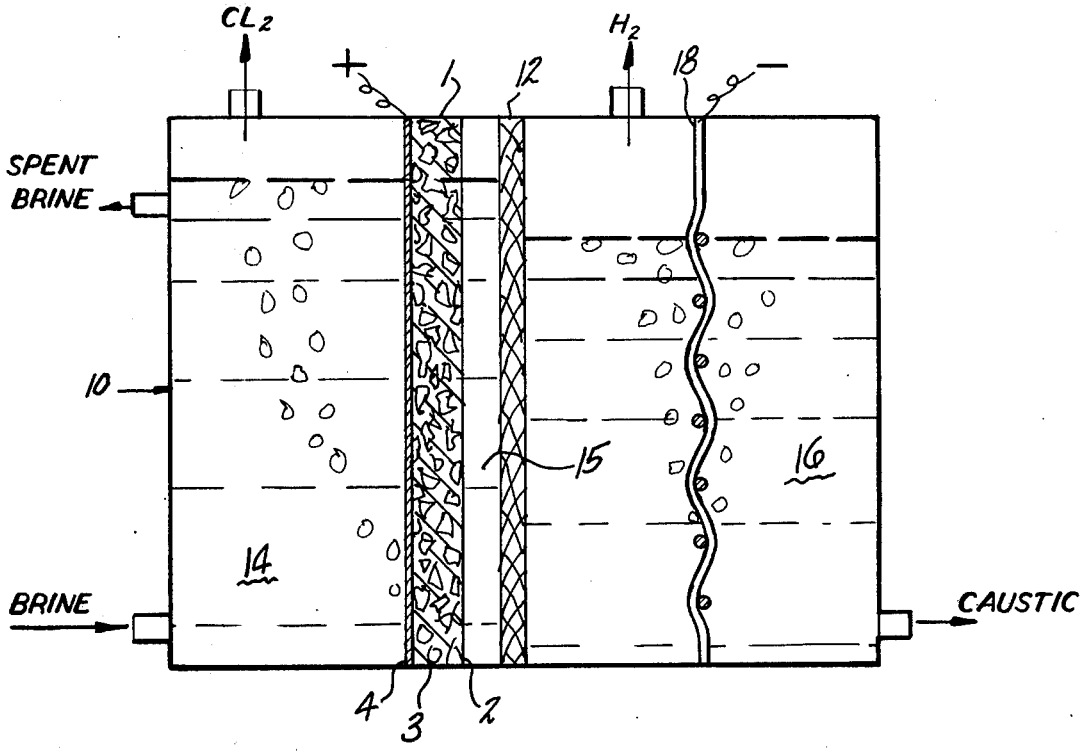
FIG. 1 illustrates a schematic view of the novel cell of the present invention.
Figure 2:
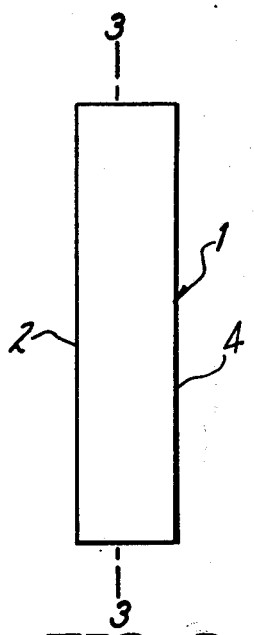
FIG. 2 represents a side view of a porous anode separator used in the cell of the present invention.
Figure 3:
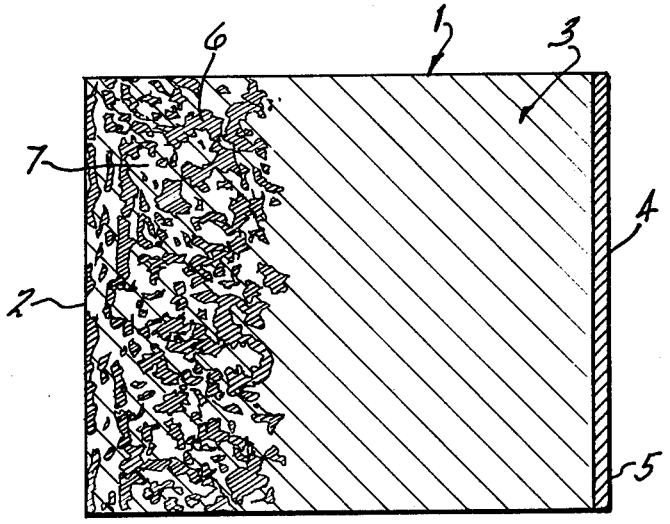
FIG. 3 depicts a cross-section of the porous anode separator taken along line 3—3 of FIG. 2.

FIG. 1 illustrates a schematic view of cell 10. Cation permeable divider 12 separates cell 10 into an anode compartment 14 and cathode compartment 16. Porous anode separator 1 having face 4 and back 2 is positioned in anode compartment 14 so that back 2 is nearest but spaced apart from cation permeable divider 12. Alkaline brine zone 15 is formed between back 2 and cation permeable divider 12. Cathode 18 is positioned in cathode compartment 16. As illustrated in FIGS. 2-3, porous anode separator 1 has a face 4, a back 2 and an interior structure 3. Face 4 is coated with electroactive coating 5. Back 2 and a portion of interior structure 3 have a barrier layer which is a mixture of a ceramic oxide 6 and a valve metal oxide 7.

Suitable for use as an anode in the cell and process of the present invention is an anode separator comprising a porous plate of a valve metal having a face, a back and an interior structure. U.S. patent application Ser. No. 627,995, filed Nov. 3, 1975, now U.S. Pat. No. 4,032,427, issued June 28, 1977, to I. V. Kadija discloses a suitable anode separator. The entire disclosure of that application is incorporated by reference herein. The face has an electrochemically active coating which is selected from the group consisting of a platinum group metal, a platinum group metal oxide, and mixtures thereof. The back and at least 10 percent of the interior structure have a barrier layer comprising a mixture of a valve metal oxide and a ceramic oxide. The ceramic oxide is selected from the group consisting of silicon oxide, aluminum oxide, magnesium oxide, calcium oxide and mixtures thereof.

A porous plate of a valve metal is used as the anode separator in the present invention. The plate has a thickness of from about 1/24th to about ⅜ths of an inch, preferably from about 1/16th to about ¼th of an inch, and more preferably from about 1/16th to about ⅛th of an inch. While plates having a thickness greater than ⅜ths of an inch may be used, they have less desirable separation properties.

A suitable porosity for the porous plate is that of from about 30 to about 75 percent. The porosity is defined as the ratio of the void to the total volume of the porous plate. A preferred porosity is from about 40 to about 70 percent. Any convenient pore size may be used for example, from about 5 microns to about 500 microns, preferably from about 10 to about 100 microns, and more preferably from about 25 to about 50 microns. The porosity can be random as no particular directional orientation is required, but it is preferred that the porosity be uniform throughout the porous plate.

Porous plates of valve metals are available commercially or can be produced by a process such as sintering a metal in powder form.

Where improved mechanical strength is desired for the porous plate, for example, for anodes having a large surface area, the interior of the plate may include a foraminous structure of the valve metal such as an expanded mesh or net or a perforated plate. The foaminous structure is enveloped by the porous plate. A mesh reinforced valve metal plate is commercially available, for example, from Gould, Inc.

For the purposes of this specification, a valve metal is a metal which, in an electrolytic cell, can function generally as a cathode, but not generally as an anode as an oxide of the metal forms under anodic conditions. This oxide is highly resistant to the passage therethrough of electrons.

Suitable valve metals include titanium, tantalum, or niobium, with titanium being preferred.

The porous plate is coated on the back and a portion of the interior with a barrier layer which serves as the electrochemically non-active layer. The barrier layer comprises a mixture of a valve metal oxide with a ceramic oxide. A valve metal oxide is an oxide of titanium, tantalum or niobium where the valve metal is defined as above. A preferred valve metal oxide is titanium oxide. The ceramic oxide is selected from the group consisting of silicon oxide, aluminum oxide, magnesium oxide, and calcium oxide. The barrier layer may be formed by any suitable method. For example, the ceramic oxide may be applied to the back and interior of the porous plate as a dispersion or solution. The coating is applied to the base in a manner which will permit the ceramic oxide to permeate the porous inner structure of the anode, but will not coat the face, that is the side which will have an electrochemically active coating. The porous plate may then be heated to a temperature of from about 400° C. to about 800° C. in an oxygen-containing atmosphere to form the barrier layer comprising a mixture of the valve metal oxide and the oxide of Si, Mg, Ca or Al, or mixtures thereof. In addition to the oxides themselves, any suitable compounds may be used in preparing the ceramic oxide portion of the barrier layer. For example, silica-containing compositions or silicone rubber may be used to provide silicon oxide while $MgCO_3$ or $Mg(OH)_2$, $CaCO_3$ or $Ca(OH)_2$ or $Al(OH)_3$ may similarly be used to prepare the oxides of Mg, Ca or Al, respectively. Where mixtures of oxides are desired, the compounds of Mg, Ca or Al may be mixed with, for example, a silicone rubber composition and the mixture applied to the back and the interior of the porous anode separator. If desired, a solvent such as hexane may be added to the mixture to provide increased permeation through the interior portion of the anode separator.

Additionally, a valve metal oxide may be added to the ceramic oxide in forming the barrier layer.

The barrier layer thickness on the back of the porous anode separator is not critical and any suitable thickness may be employed which is electrochemically non-reactive with respect to the alkali metal chloride solution.

To serve as an effective separator, at least about 10 percent of the interior structure should be coated by the barrier layer mixture. For example, a satisfactory anode separator is obtained by coating a proportion of from about 10 percent to about 90 percent of the interior structure with the barrier layer. A preferred proportion is from about 30 to about 60 percent of the interior structure of the porous plate.

As a component of the mixture, the ceramic oxide is present in amounts of from about 10 percent to about 70 percent by volume of the total mixture. Preferably, the ceramic oxide constitutes from about 20 percent to about 40 percent by volume of the total mixture. While any of the ceramic oxides may be suitably used in the barrier layer of the anode separator used in the present invention, silicon oxide and aluminum oxide are preferred, with silicon oxide being most preferred.

The face of the porous titanium plate is coated with a platinum group metal or platinum group metal oxide or mixtures thereof using any of several well known procedures, as described, for example, in U.S. Pat. No. 3,630,768, issued to Bianchi et al, U.S. Pat. No. 3,853,739, issued to Kolb et al, U.S. Pat. No. 3,773,555, issued to Cotton et al, or U.S. Pat. No. 3,578,572, issued to Lee. The term "platinum group metal" as used in the specification means an element of the group consisting of ruthenium, rhodium, palladium, osmium, iridium, and platinum.

Where the electrochemically active coating includes a platinum group metal oxide, the oxidation procedure used to form the barrier layer can be employed simultaneously to form the platinum group metal oxide.

Any suitable thickness may be used for the electrochemically active coating providing the coating is present in an amount sufficient to function effectively as an anode in the electrolysis of alkali metal chloride solutions. It has been found, however, that a considerable reduction in the amount of platinum group metal or platinum group metal oxide required is achieved when employing the porous anode separator described above. For example, loading amounts of the platinum group metal or metal oxide can be reduced by over 50 percent below those used in coating non-porous anodes of titanium or tantalum.

While any suitable portion of the face of the porous anode plate may be coated with the electrochemically active coating, it is preferred that the electrochemically active coating essentially cover the anode face.

Further, the electrochemically active coating may be made partly hydrophobic by applying a coating of a polymeric material such as polytetrafluoroethylene, for example, by spraying or painting over a portion of the face of the porous anode.

In the novel cell of the present invention, the anode separator is positioned in the anode compartment with the back, having the barrier layer, closest to the cation permeable divider. The space between the anode separator and the cation permeable divider is reduced over that used when a foraminous metal anode is employed resulting in lower cell voltages. Suitable distances between the anode separtor and the cation permeable divider are, for example, from about 1/50th to about ½, preferably from about 1/32nd to about ¼th of an inch.

The cell and process of the present invention suitably electrolyze, for example, aqueous solutions of alkali metal chlorides to produce chlorine and an alkali metal hydroxide solution. Alkali metal chloride solutions having a pH of from about 2 to about 11 are fed to the anode compartment.

During electrolysis, for example, of an aqueous solution of sodium chloride, electrolytic decomposition in the anode compartment takes place along the face of the anode separator. Chlorine gas is formed and released along the electrochemically active face with little penetration of chlorine into the interior structure because of the barrier layer. Hydrated Na ions formed during the electrolysis, along with sodium chloride solution pass through the porous anode structure to the space between the back of the anode separator and the cation permeable divider. Hydrated sodium ions, water molecules, and, depending on the cation permeable divider selection, sodium chloride solution, pass from the alkaline zone into the cathode compartment. Electrolysis using the anode separator produces an alkaline zone between the back of the anode separator and the cation permeable divider. This alkaline zone, has a pH of from about 7 to about 14, and preferably from about 10 to about 14.

Surprisingly, the creation of an alkaline zone between the anode separator and the cation permeable divider provides a number of advantages over electrolytic processes employing acidic brine solutions and foraminous metal anodes. These advantages include: a reduction in cell voltage; a reduction in back migration of hydroxyl ions from the cathode compartment with lower concentrations of chlorate and hypochlorite being produced; improved chlorine purity; increased cation permeable divider life; and increased service life for the electroconductive coating on the anode face.

In addition, the cell of the present invention provides for the removal of impurities, such as alkaline earth metal compounds, before they are introduced into the cation permeable divider. Employment of the porous anode separator extends the alkaline zone on the anolyte side of the divider so that the residence time for settling out impurities from the brine is increased by several orders of magnitude. This greatly reduces the amount of impurities which are introduced into the cation permeable divider and significantly increases the service life of the cation permeable divider.

Electrolysis of the sodium chloride solution along the face of the anode separator also results in a lower pH of the NaCl solution than occurs in a cell equipped with a standard anode which prolongs the life of the electroconductive coating when a platinum group metal or metal compound is used.

As chlorine formation takes place along the face of the anode separator, the alkaline zone is substantially free of gas evolution and the formation of chlorates and hypochlorites in the anolyte is greatly reduced so that the corrosive acidic conditions normally found on the anode side of the cation permeable divider are absent so that desired flow rates are maintained and the service life of the dividers is prolonged.

Any cation permeable divider may be used whose flow rate is favorably influenced by an alkaline solution on the anolyte side of the divider. Suitable dividers include those which permit bulk flow of the alkali metal chloride solution such as asbestos, fabrics of plastics such as polytetrafluoroethylene, polystyrene, polypropylene, polyvinylchloride, polyvinylidene chloride and polyvinyldifluoride. Also suitable are materials having cation exchange properties such as dividers fabricated of fluorocarbon such as perfluorosulfonic acid resins or perfluorocarboxcylic acid resins which are available as hydraulically impermeable membranes or as porous diaphragms.

Suitable fluorocarbon resins include those having the units $$\left(C_mF_{2m}\right)_M \quad \text{and} \quad \left(CF_2-\underset{\underset{X}{|}}{CF}\right)_N$$

where m is from 2 to 10, the ratio of M to N is sufficient to provide an equivalent weight of from 600 to 2000, and X is selected from:

A, or (i)

-continued $$\left(OCF_2-\underset{\underset{Z}{|}}{CF}\right)_p-A \qquad \text{(ii)}$$

where p is from 1 to 3 and Z is F or a perfluoroalkyl group having from 1 to 10 carbon atoms provided that in either of these cases (i) and (ii), A is a group selected from:

$SO_2F$, $SO_3H$, $CF_2SO_3H$, $CCl_2SO_3H$, $X'SO_3H$, $PO_3H_2$, $PO_2H_2$, COOH, and X'OH where X' is an arylene group.

Preferred ion exchange resins are those in which X is COOH, $SO_2F$, $SO_3H$, $OCF_2CF_2SO_3H$, or $OCF_2CF_2COOH$.

Suitable cation permeable dividers may be fabricated from perfluorocarboxylic acid resins having the formula:

$$CF_2CF_2\underset{\underset{(OCF_2\underset{\underset{CF_3}{|}}{CF})_n-OCF_2CF_2COOH}{|}}{CF}CF_2$$

where n is an integer of 0 to about 3.

Preferred as cation permeable dividers are those fabricated from perfluorosulfonic acid resins which are commercially available from E. I. DuPont de Nemours and Co. under the trademark "NAFION". These resins are comprised of copolymers of a perfluoroolefin and a fluorosulfonated perfluorovinyl ether. Suitable perfluoroolefins include tetrafluoroethylene, hexafluoropropylene, octafluorobutylene and higher homologues, with tetrafluoroethylene being particularly preferred. The fluorosulfonated perfluorovinyl ethers are compounds illustrated by the formulas:

$FSO_2CF_2CF_2OCF{=}CF_2$ $FSO_2CF_2CF_2OCF(CF_3)CF_2OCF(CF_3)CF_2OCF{=}CF_2$ $FSO_2CF_2CF_2CF_2CF_2OCF(CF_3)CF_2OCF{=}CF_2$, and $FSO_2CF_2CF_2OCF(CF_3)CF_2OCF{=}CF_2$.

A particularly preferred sulfonated perfluorovinyl ether is that of the formula:

$FSO_2CF_2CF_2OCF(CF_3)CF_2OCF{=}CF_2$, perfluoro[2-(2-fluorosulfonylethoxy) propyl vinyl ether].

The sulfonated perfluorovinyl ethers are prepared by methods described in U.S. Pat. No. 3,041,317 to Gibbs et al, No. 3,282,875 to Connolly et al, No. 3,560,568 to Resnick, and No. 3,718,627 to Grot.

The copolymers employed in the cationic permselective membrane of the present invention are prepared by methods described in U.S. Pat. No. 3,041,317 to Gibbs et al, No. 3,282,875 to Connolly et al, and No. 3,692,569 to Grot.

The solid fluorocarbon polymers are prepared by copolymerizing the perfluoroolefin, for example, tetrafluoroethylene with the sulfonated perfluorovinyl ether followed by converting the $FSO_2$ group to $SO_3H$ or a sulfonate group (such as an alkali metal sulfonate) or a mixture thereof. The equivalent weight of the perfluorocarbon copolymer ranges from about 900 to about 1600, and preferably from about 1100 to about 1500. The equivalent weight is defined as the average molecular weight per sulfonyl group.

The cell and process of the present invention can be used for the electrolysis of alkali metal chloride solutions including sodium chloride, potassium chloride, lithium chloride, rubidium chloride, and cesium chloride, with sodium chloride and potassium chloride being preferred. Aqueous solutions of these alkali metal chlorides fed to the anode compartment are acidified to provide a pH which is that normally used for the brine fed to a diaphragm-type cell. For example, the pH of the aqueous solution where sodium chloride is used as the alkali metal chloride is from about 2 to about 11.

Any suitable cathode may be used in the cathode compartment, for example, foraminous structures of metals such as steel, nickel, copper or alloys thereof.

The cell and process of the present invention are further illustrated by the following examples. All parts and percentages are by weight unless otherwise indicated.

EXAMPLE 1

A commercially available porous titanium plate 1/16th of an inch thick and having a porosity of 60 percent and an average pore size of 25 microns was coated on one side with a thin protective coat of silicone rubber (General Electric Co. RTV-102). The silicone rubber penetrated the interior of the porous plate, but was prevented from coating the face of the plate. The rubber coated side was cured at room temperature over a 2 hour period. The face or uncoated side of the porous titanium plate was then painted with a 10 percent solution of $RuCl_4$ in 0.1N HCl. The plate was then baked in an oven at 400° C. for 5 minutes. Following cooling, the face was recoated with the $RuCl_4$ solution and the porous plate then heated in an oven having an air atmosphere for about 6 hours at 400° C. During this heating, the silicone rubber coated titanium was oxidized and a mixture of silicon dioxide and titanium dioxide formed on the back and throughout the porous structure of the plate. An electrochemically active coating of ruthenium dioxide formed on the front of the plate. Photomicrographs obtained using a scanning electron microscope established that the silicon dioxide was evenly distributed throughout the barrier layer as a mixture with titanium dioxide containing about 30 percent by volume of $SiO_2$. The barrier layer mixture covered about 50 percent of the interior structure of the porous plate.

The anode separator prepared above was positioned in the anode compartment of the cell illustrated in FIG. 1 so that the back of the anode was spaced apart from a cation permeable diaphragm by a distance of 1/16th of an inch. The cation permeable divider employed was a microporous laminate of a film 7 mils thick of 1100 equivalent weight perfluorosulfonic acid resin with T-12 fabric of polytetrafluoroethylene. This divider is available commercially from E. I. DuPont de Nemours and Co. as NAFION® Diaphragm 701. A stainless steel screen cathode was positioned in the cell at a distance of about 1/16th of an inch from the cation permeable divider. An aqueous solution containing 260 grams per liter of NaCl was fed to the anode compartment at a temperature of 80° C. and a pH of about 8 and spent NaCl continuously removed. An anolyte head level of 12 inches was maintained. Current was fed to the anode separator to provide a current density of about 1.55KA/$m^2$. Electrolysis proceeded with chlorine evolved at the anode and hydrogen produced at the cathode. A plexiglass cell body permitted visual observations which verified that the $Cl_2$ gas was evolved only in the area adjacent to the face of the anode separator and that there was no gas release in the space between the back of the anode separator and the cation permeable divider.

A sample of brine in the alkaline zone between the anode separator and the cation permeable divider was continuously removed from the cell (from an outlet not shown in FIG. 1) and periodically analyzed and the pH determined. Caustic liquor produced was similarly analyzed, the cell voltage measured and the cathode current efficiency determined. These results are shown the Table 1 below. One measurement was made of the pH of the anolyte at the face of the anode separator which was found to be 1.5. The cell was operated for two weeks during which satisfactory flow rates thru the cation permeable divider were maintained and no plugging of the cation permeable divider occurred.

TABLE 1

Electrolysis of NaCl with Porous Anode Separator - Example 1

| Determination No. | Brine Feed Rate (1./min)* | Anolyte From Alkaline Zone (weight %) pH | NaCl | NaOCl | $NaClO_3$ | Free $Cl_2$ |
|---|---|---|---|---|---|---|
| 1. | 1.49 | — | 20.88 | 0.016 | 0.008 | 0.002 |
| 2. | 0.85 | 12 | 19.94 | 0.016 | 0.006 | 0.002 |
| 3. | 1.61 | 11.1 | 22.52 | 0.015 | 0.008 | 0.002 |
| 4. | 1.75 | 11.4 | 20.77 | 0.017 | 0.004 | 0.001 |

| Determination No. | Catholyte Removal Rate (1./min)* | Catholyte (weight %) NaOH | NaCl | NaOCl | $NaClO_3$ | Cell Voltage | Cathode Current Efficiency |
|---|---|---|---|---|---|---|---|
| 1. | 0.33 | 8.85 | 14.70 | 0.003 | 0.006 | 3.18 | 91.66 |
| 2. | 0.31 | 9.32 | 14.04 | 0.002 | 0.017 | 3.26 | 90.62 |
| 3. | 0.28 | 9.87 | 15.65 | 0.005 | 0.009 | 3.10 | 88.25 |
| 4. | 0.21 | 12.06 | 13.00 | 0.000 | 0.002 | 3.25 | 83.00 |

*per square meter of anode surface

EXAMPLE 2

Figure 4:
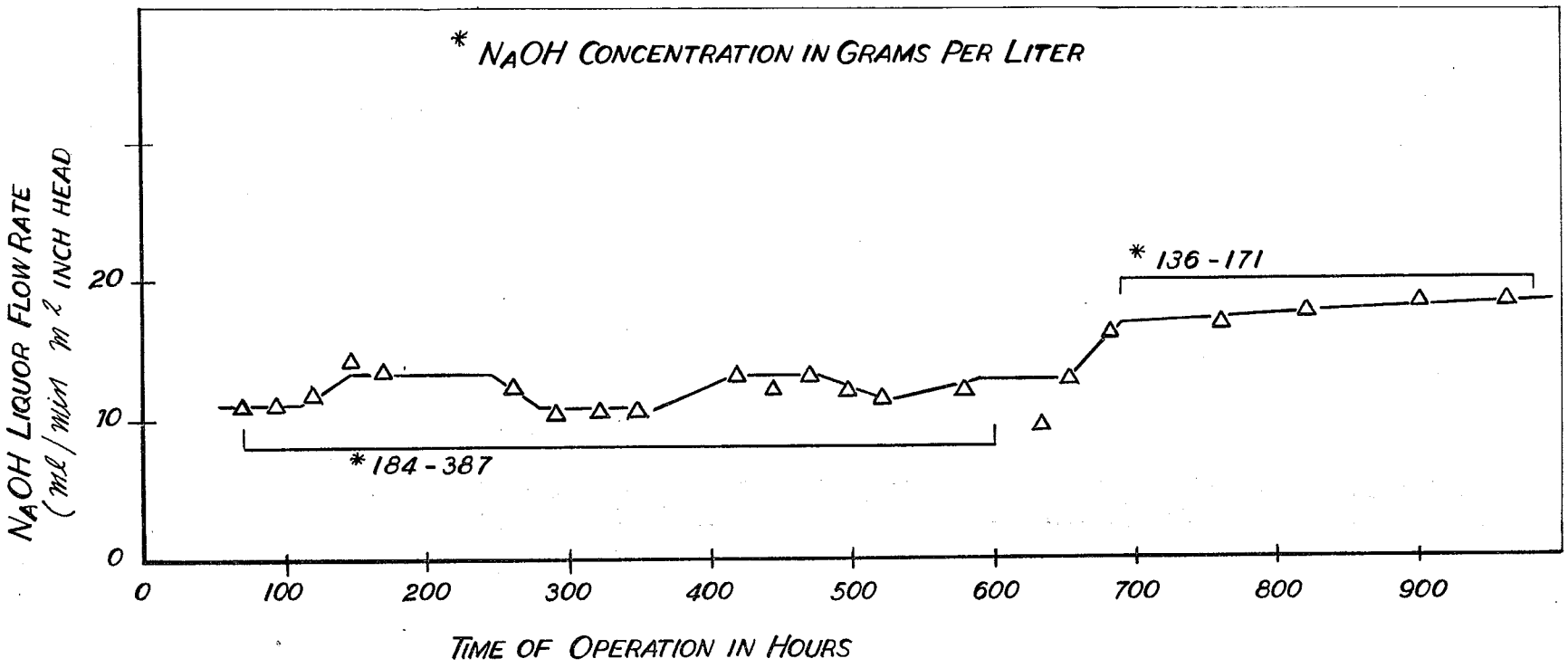
FIG. 4 is a graph illustrating the flow rate of NaOH liquor over the period of cell operation.

The cell of FIG. 1 was operated by the procedure of Example 1 with the exception that brine was not continuously removed from the alkaline zone between the back of the anode separator and the cation permeable divider. Over a period of 960 hours, sodium hydroxide solutions in the range of 136 to 387 grams per liter were produced, with the concentration being controlled in the range of 136 to 171 grams per liter over the last 260 hours of operation. Cathode current efficiency was in the range of 88–93 percent with the cell voltage being 3.3 to 3.5. No plugging of the cation permeable divider occurred during the period of operation. A favorable flow of sodium hydroxide cell liquor was maintained from the cathode compartment as shown in FIG. 4.

What is claimed is:

1. A cell for electrolyzing alkali metal chloride solutions comprised of an anode compartment, a cathode compartment, a cation permeable divider separating said anode compartment from said cathode compartment, a cathode in said cathode compartment, an anode separator serving as the anode in said anode compartment, wherein said anode separator is comprised of a porous plate of a valve metal selected from the group consisting of titanium, tantalum and niobium, said porous plate having a face, a back and an interior structure, said face having an electrochemically active coating selected from the group consisting of a platinum group metal, a platinum group metal oxide and mixtures thereof, said back and a portion of said interior having an electrochemically non-active barrier layer, said electrochemically non-active barrier layer comprising a mixture of a valve metal oxide selected from the group consisting of titanium oxide, tantalum oxide and niobium oxide with a ceramic oxide selected from the group consisting of silicon oxide, aluminum oxide, magnesium oxide, calcium oxide and mixtures thereof, wherein said portion having said barrier layer is at least 10 percent of said interior structure, and said cation permeable divider is spaced apart from said back of said anode separator.

2. A process for electrolyzing alkali metal chloride solutions employing the cell of claim 1.

3. The cell of claim 1 in which said cation permeable divider is spaced apart from said back of said anode separator a distance of from about 1/50th to about ½ of an inch to provide an alkaline brine zone.

4. A process for electrolyzing alkali metal chloride solutions employing the cell of claim 3.

5. The cell of claim 3 in which said anode separator has a thickness of from about 1/16th to about ½ of an inch.

6. The cell of claim 5 in which said anode separator has a porosity of from about 30 percent to about 75 percent and a pore size of from about 5 microns to about 500 microns.

7. The cell of claim 6 in which said porous plate has a foraminous structure of a valve metal enveloped by said porous plate.

8. The cell of claim 7 in which said foraminous structure is an expanded titanium mesh.

9. The cell of claim 1 in which said valve metal is titanium and said ceramic oxide is silicon oxide.

10. The cell of claim 9 in which said valve metal oxide is selected from the group consisting of titanium oxide and tantalum oxide.

11. The cell of claim 10 in which the cation permeable divider is selected from the group consisting of perfluorosulfonic acid resins having an equivalent weight of from about 900 to about 1600.

12. A process for electrolyzing alkali metal chloride solutions employing the cell of claim 10.

13. The cell of claim 1 in which said valve metal oxide is titanium oxide and said ceramic oxide is selected from the group consisting of silicon oxide, aluminum oxide and mixtures thereof.

14. The cell of claim 13 in which said electrochemically active coating is a platinum group metal oxide selected from the group consisting of platinum oxide, palladium oxide, iridium oxide, ruthenium oxide, rhodium oxide and osmium oxide.

15. The cell of claim 14 in which said electrochemically active coating is ruthenium oxide.

16. The cell of claim 15 in which said cation permeable divider is selected from the group consisting of perfluorosulfonic acid resins having an equivalent weight of from about 900 to about 1600.

17. A process for electrolyzing sodium chloride solutions employing the cell of claim 16.

* * * * *